US005103614A

United States Patent [19]

Kawaguchi et al.

[11] Patent Number: 5,103,614

[45] Date of Patent: Apr. 14, 1992

[54] SOUNDPROOFING WOODY FLOORING

[75] Inventors: Shiro Kawaguchi; Katsunori Kai, both of Osaka, Japan

[73] Assignee: Eidai Industry Co., Ltd., Osaka, Japan

[21] Appl. No.: 412,607

[22] Filed: Sep. 26, 1989

Related U.S. Application Data

[63] Continuation of Ser. No. 193,334, May 12, 1988, abandoned.

[30] Foreign Application Priority Data

May 12, 1987 [JP] Japan ..... 62-69691[U]

[51] Int. Cl.[5] ..... E04F 15/02; E04B 5/00

[52] U.S. Cl. ..... 52/392; 52/403

[58] Field of Search ..... 52/384, 392.3, 403, 52/408, 480, 98, 743, 744

[56] References Cited

U.S. PATENT DOCUMENTS

| | | | |
|---|---|---|---|
| 885,751 | 4/1908 | Heaton . | |
| 2,088,238 | 7/1937 | Greenway . | |
| 2,119,804 | 6/1938 | Crooks | 52/392 X |
| 2,123,409 | 7/1938 | Elmendorf | 20/7 |
| 2,405,235 | 8/1946 | Randall | 52/403 X |
| 2,491,498 | 12/1949 | Kahr | 20/75 |
| 2,860,385 | 11/1958 | Cohn | 20/8 |
| 2,904,990 | 9/1959 | Emmerling | 52/392 X |
| 3,084,403 | 4/1963 | Elmendorf | 20/15 |
| 3,527,004 | 9/1970 | Sorensen | 52/98 |
| 3,579,941 | 5/1971 | Tibbals | 52/384 |
| 3,717,247 | 2/1973 | Moore | 206/59 F |
| 4,315,392 | 2/1982 | Sylvest | 52/408 X |
| 4,416,100 | 11/1983 | Troendle | 52/384 X |
| 4,449,336 | 5/1984 | Kelly | 52/408 X |
| 4,644,720 | 2/1987 | Schneider | 52/403 X |

FOREIGN PATENT DOCUMENTS

| | | | |
|---|---|---|---|
| 1147651 | 4/1956 | France . | |
| 54-21477 | 7/1979 | Japan . | |
| 61-107828 | 7/1986 | Japan . | |
| 62-1969 | 1/1987 | Japan . | |
| 1141945 | 2/1969 | United Kingdom | 52/403 X |

*Primary Examiner*—David A. Scherbel
*Assistant Examiner*—Michele A. VanPatten
*Attorney, Agent, or Firm*—Morgan & Finnegan

[57] ABSTRACT

A soundproofing woody flooring comprises a top woody board, a sheet of sound insulating, vibration damping or buffering material glued to the top board, a perforated woody board glued to the sheet on the opposite side thereof from the top board, and a bottom buffering material glued to the perforated woody board on the opposite side thereof from the sheet. The buffering sheet preferably has one surface to which a fabric is bonded. More preferably, it has one surface to which a fabric is bonded, while the opposite surface of the sheet from the fabric is provided with small holes having a depth which is smaller than the thickness of the sheet.

10 Claims, 6 Drawing Sheets

SOUNDPROOFING WOODY FLOORING

This is a continuation of application Ser. No. 193,334, filed on May 12, 1988, now abandoned.

BACKGROUND OF THE INVENTION

1. Field of the Invention

This invention relates to a soundproofing woody flooring, particularly one which is suitable for direct application to a concrete base.

2. Description of the Prior Art

It has been usual to place felt on a concrete base and cover the felt with a carpet in order to construct the floor of a room in a medium- or multi-story residential building. The carpet has, however, a number of defects. It is easily soiled. A great deal of time and labor are required for changing a soiled carpet to a new one. The carpet provides a comfortable house for ticks.

Therefore, it is nowadays often the case to apply woody flooring directly to a concrete base without using any carpet. The woody flooring is, however, less sound-proofing than the carpet and fails to provide a calm living environment. This drawback can be improved to some extent if the bottom surface of the flooring is covered with a plastic foam. Its soundproofing property is, however, still far from satisfactory.

SUMMARY OF THE INVENTION

Under these circumstances, it is an object of this invention to provide a highly soundproofing woody flooring.

This object is attained by a woody flooring which comprises a woody board having a top surface defining the surface of a floor and a bottom surface, a sound insulating vibration damping, or buffering sheet bonded to the bottom surface of the board, a perforated woody board bonded to the sheet, and a buffering material bonded to the perforated woody board.

The buffering sheet preferably has one surface to which a nonwoven or woven fabric is bonded. More preferably, it has one surface to which a nonwoven or woven fabric is bonded, while the opposite surface of the sheet from the fabric is provided with small holes having a depth which is smaller than the thickness of the sheet.

Other features of this invention will be apparent from the following description and the accompanying drawings.

DETAILED DESCRIPTION

Figure 1:
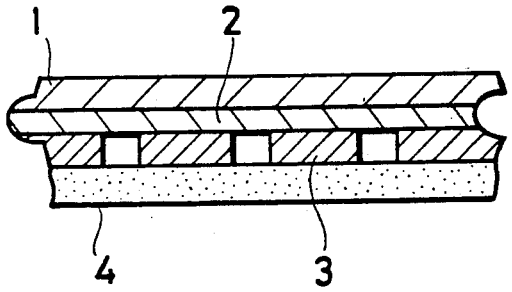
FIG. 1 is a cross sectional view of a part of flooring embodying this invention.
Figure 2:
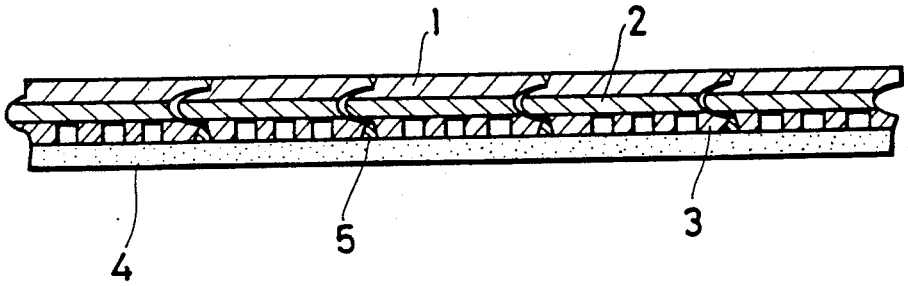
FIG. 2 is a cross sectional view of an assembly of a plurality of pieces of flooring embodying this invention.

A piece of flooring embodying this invention is shown in FIG. 1. It comprises a woody board 1 having a top surface adapted to define the surface of a floor, a sound insulating, vibration damping, or buffering sheet 2 bonded to the bottom surface of the woody board 1, a perforated woody board 3 laid under the sheet 2 and bonded thereto, and a buffering material 4 laid under the perforated woody board 3 and bonded thereto. The woody board 1 may, for example, comprise plywood, particle board, hardboard, or laminated veneer lumber. Its surface may have a decorative finish which can, for example, be achieved by glueing a layer of decorative wood or a decorative sheet of a synthetic resin to the surface, or by coating it in a decorative way. No such decorative finish is, however, required if the flooring of this invention is not used to form the exposed surface of a floor. The board 1 preferably has a thickness of 2.5 to 3.3 mm. The flooring may comprise either a single piece of board which may measure, say 30 cm by 90 cm, or a combination of a plurality of smaller pieces of board as shown in FIG. 2. The latter type of construction is better from a soundproofing standpoint.

In the case where a sound insulating sheet is used as the sheet 2, the purpose of its use resides in sound shielding, that is, in rejecting sound by means of reflecting sound. Consequently, various properties required for a sound insulating sheet include no air-permeability, high weight, especially high surface density in $kg/m^2$, high internal viscosity, etc. It may, for example, comprise a sheet of vinyl chloride containing lead powder, rubber containing inorganic powder, etc.

In the case where a vibration damping sheet is used as the sheet 2, the purpose of its use is to prevent vibration. The typical examples of a vibration damping sheet includes a sheet of rubber, vinyl chloride and the like.

In the case where a buffering sheet is used as the sheet 2, it is directed to the purpose of absorbing vibration as well as sound and is exemplified by a sheet of foamed material such as rubber foam, polyethylene foam, polyurethane foam and the like.

According to this invention, the presence of an intermediate woody board between the sheet 2 and the buffering material 4 is effective from a soundproofing standpoint. The perforated woody board 3 is particularly effective. The board may, for example, comprise plywood, laminated veneer lumber, hardboard, or particle board. It preferably has a thickness of 2.5 to 4.0 mm. The perforated board 3 has a plurality of holes each having preferably a diameter of 5 to 15 mm.

Figure 3:
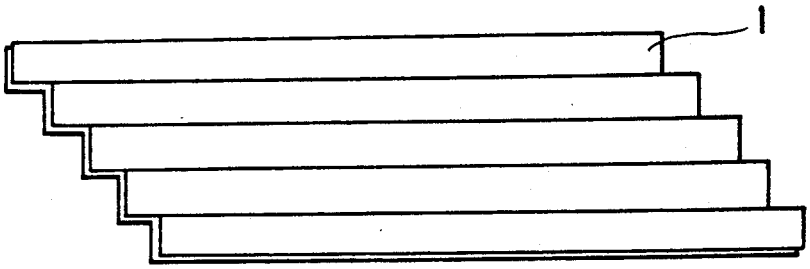
FIG. 3 is a top plan view of FIG. 2.

As a top plan view of an assembly of a plurality of pieces of flooring embodying this invention, FIG. 3 illustrates pieces that are arranged and joined along the longitudinal edges thereof with transverse edges being located in generally staggered relation from each other to the longitudinal direction to avoid alignment of transverse edges.

Figure 4:
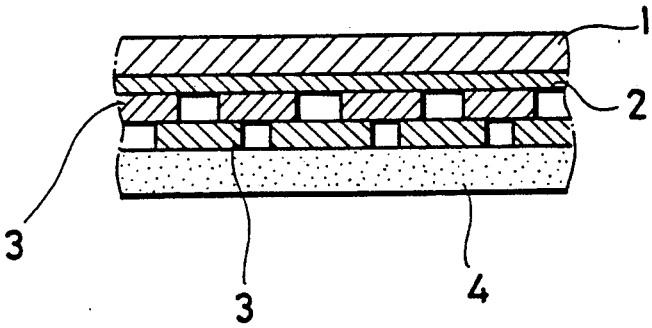
FIG. 4 is a view similar to FIG. 1, but showing a modified form of flooring.

While the flooring shown in FIG. 1 includes only a single perforated woody board 3, a modified form of flooring which is shown in FIG. 4 includes two perforated woody boards 3. The holes of one of the boards 3 are located in a staggered relation to the holes of the other board 3. The flooring of FIG. 4 provides a still improved soundproofing effect.

The buffering material 4 may, for example, comprise a polyethylene, polyurethane or rubber foam. A closed-cell foam is preferable, as it has excellent waterproofing property and is less likely to collapse or deform than an open-cell one. The buffering material may also comprise a rubber foam having a woven fabric of jute glued to its surface defining the bottom of the flooring.

If the buffering material permits the formation of projections, it is beneficial to provide projections on its bottom surface, as they contribute to reducing the area of contact between the flooring and a concrete base and thereby improving the soundproofing property of the flooring to a still further extent. The projections may be circular, oval, rectangular, etc. in cross section, and preferably have a diameter or thickness of, say, 10 mm and a height of, say, 1 to 2 mm.

Every two adjoining pieces of flooring may be joined together by a rabbet joint extending through the top board 1, the sheet 2 and the perforated woody board 3, as shown in FIG. 2. This rabbet joint may be formed, for example, from generally opposed tongue and groove formations, a tongue being formed on one piece of flooring so as to be opposed by a groove formed on the opposing piece of flooring. Moreover, as is evident from FIGS. 1 and 2, notched surfaces can be formed in woody board 3 below the tongue and groove formations, respectively. Thus, when adjacent pairs of flooring are joined (i.e., FIG. 2), the notched surfaces define groove-like cavities.

Figure 8:
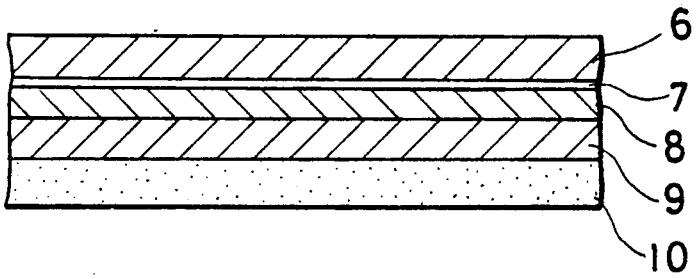
FIG. 8 is a cross sectional view of a piece of flooring according to another embodiment of this invention.

Another embodiment of this invention is shown in FIG. 8. It comprises a woody board 6, a buffering sheet 8 having a woven or unwoven fabric 7 glued to one surface thereof, an intermediate woody board 9 and a buffering material 10 which are glued to one another as shown in FIG. 8. The woody board 6 may be of the same material as board 1 which has hereinabove been described with reference to FIG. 1. It preferably has a thickness of 2.5 to 4.0 mm. While it may comprise only a single piece measuring 30 cm by 90 cm, it is better from a soundproofing standpoint to combine a plurality of smaller pieces as shown in FIG. 9.

The buffering sheet 8 may, for example, comprise a sheet of a rubber or olefin foam having one surface to which an unwoven fabric or a woven fabric of cotton or staple fiber is glued. While the buffering sheet itself is so elastic that it is fairly difficult to apply to the woody board and easily loses its uniformity in thickness when glued thereto, the woven or unwoven fabric overcomes any such drawback of the buffering sheet and improves its adherence to the woody board.

The intermediate woody board 9 may, for example, comprise plywood, laminated veneer lumber, hardboard or particle board. Its thickness preferably ranges from 2.5 to 4.0 mm. The buffering material 10 may, for example, comprise a polyolefin or rubber foam. A closed-cell foam is preferable, as it has excellent waterproofing property and is less likely to collapse or deform than an open-cell one.

Figure 9:
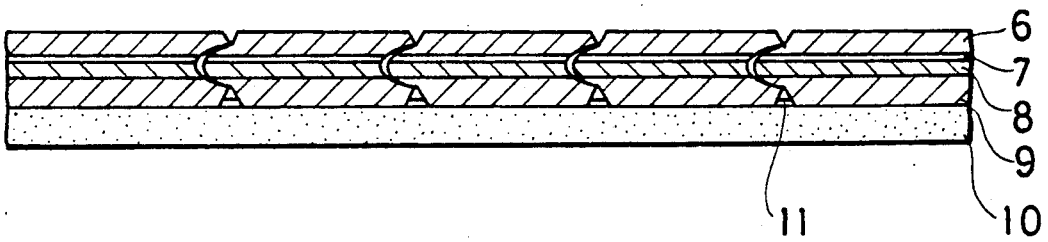
FIG. 9 is a cross sectional view of an assembly of a plurality of pieces of flooring embodying this invention.

FIG. 9 represents a tongue and groove assembly of multiple pieces of the woody flooring embodied by FIG. 8. Similar to the construction previously described for FIG. 2 herein, groove-like cavities 11 are defined by notched surfaces formed in intermediate board 9 below the tongue and groove assemblies of the pieces of flooring.

Figure 10:
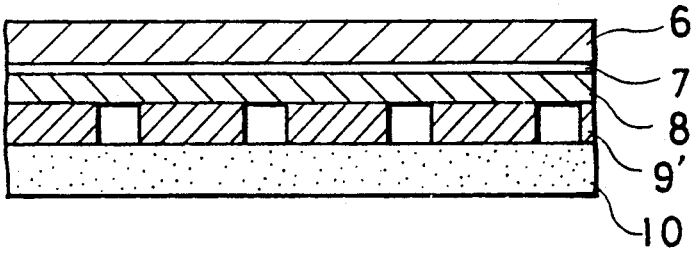
FIG. 10 is a view similar to FIG. 8, but showing a modified form of flooring.

A modified form of flooring is shown in FIG. 10. It includes a perforated woody board 9' instead of the intermediate woody board 9 shown in FIG. 8, and can produce a still improved soundproofing effect. The modified form of flooring may comprise either a single piece of board or a combination of a plurality of smaller pieces of board as shown in FIG. 9.

Figure 11:
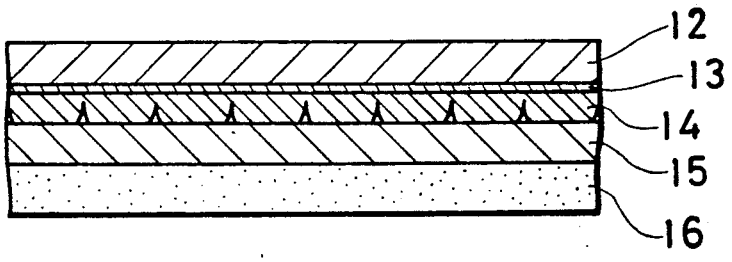
FIG. 11 is a cross sectional view of a piece of flooring according to still another embodiment of this invention.

Attention is now directed to FIG. 11 showing still another embodiment of this invention. It comprises a woody board 12, a buffering sheet 14 having a woven or unwoven fabric 13 glued to one surface thereof and provided in the other surface thereof with a plurality of holes, an intermediate woody board 15 and a buffering material 16 which are glued to one another as shown in FIG. 11. The holes of the sheet 14 have a depth which is smaller than its thickness. Each of the holes can be formed by, for example, thrusting a needle into the sheet. Each hole preferably has a diameter of, say, 0.2 to 2.0 mm which enables it to be easily formed and provide a good anchoring effect for an adhesive. The holes are spaced apart from one another preferably by a distance of 0.5 to 5.0 cm, or more preferably by a distance of about 1 cm. The fabric improves the adherence of the sheet 14 to the woody board 12 and the penetration of the adhesive into the holes improves the adhesion of the sheet 14 to the woody board 15.

Figure 12:
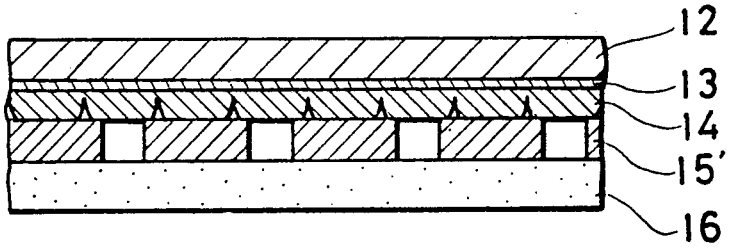
FIG. 12 is a view similar to FIG. 11, but showing a modified form of flooring.

A modified form of flooring is shown in FIG. 12. It includes a perforated woody board 15' instead of the intermediate woody board 15 shown in FIG. 11.

Figure 13:
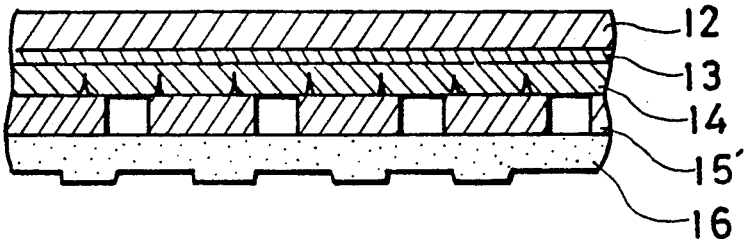
FIG. 13 is a view similar to FIG. 12, but showing a modified form of flooring.

FIG. 13 shows a modified form of the flooring shown in FIG. 12. It differs from the flooring of FIG. 12 in that the buffering material 16 is provided on the bottom surface thereof with a plurality of projections which are useful for the reason as hereinbefore set forth.

The flooring shown in FIG. 11, 12 or 13 may also comprise either a single piece, or a plurality of smaller pieces which are joined together by rabbet joints, as hereinbefore described.

The invention will now be described more specifically with reference to several examples thereof. These examples are merely illustrative and are not intended to limit the scope of this invention.

EXAMPLE 1

A piece of flooring was fabricated by joining together a decorative veneer board having a width of 300 mm, a length of 900 mm and a thickness of 2.8 mm, a 0.8 mm thick sheet of vinyl chloride containing a lead powder, a veneer board having a thickness of 2.7 mm and a rubber foam having a thickness of 5.0 mm.

EXAMPLE 2

A woody board, a sound insulating sheet and a perforated woody board were glued to one another to form a rectangular unit having a thickness of 6.3 mm, a width of 60 mm and a length of 900 mm. Five rectangular units were prepared and joined to one another by rabbet joints along the longitudinal edges thereof. Some clearance was provided at each joint to enable the joined assembly of the units to be bent to some extent at each joint to thereby fit the surface of an underlying material snugly. Every two adjoining units were bonded to each other at the bottom of the rabbet joint by a hot-melt resin forming a layer having some flexibility when cured. A single piece of buffering material was glued to the whole bottom surface of the assembly of the units, whereby a single piece of flooring was obtained. All of as those employed in EXAMPLE 1.

EXAMPLE 3

A piece of flooring was fabricated by joining together a decorative veneer board having a width of 300 mm, a length of 900 mm and a thickness of 2.8 mm, a 0.8 mm thick sheet of vinyl chloride containing a lead powder, a perforated veneer board having a thickness of 2.7 mm and a hole diameter of 10 mm and a rubber foam having a thickness of 5.0 mm.

Figure 5:
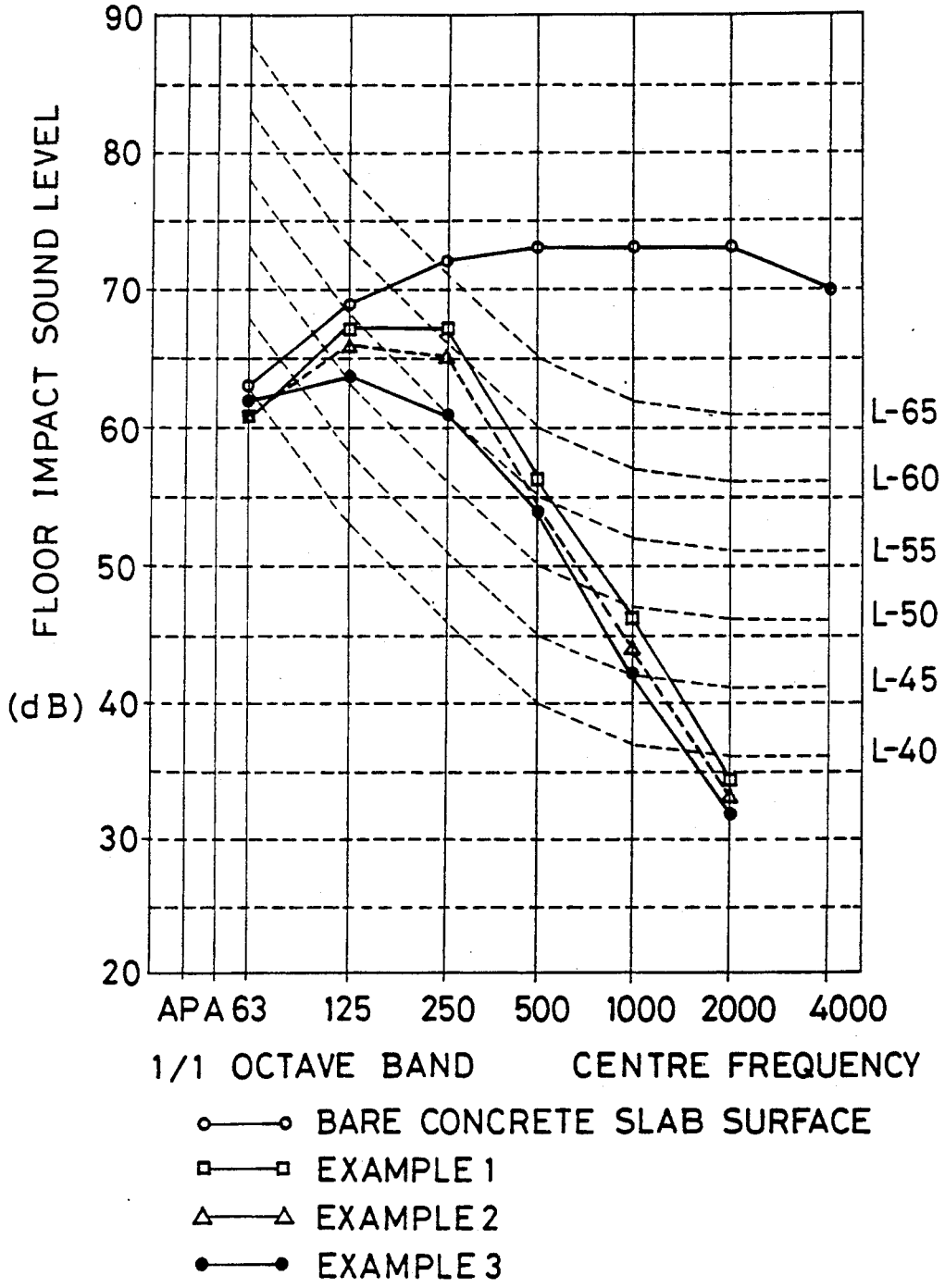
FIG. 5 is a graph showing the soundproofing property of the flooring according to some examples of this invention.

Each of the products of EXAMPLES 1 to 3 was tested for its soundproofing property. The results are shown in FIG. 5. As is obvious therefrom, all of the products according to this invention showed excellent soundproofing property, as compared with a bare concrete slab surface. It is also noted that the use of a perforated intermediate woody board is particularly effective from a soundproofing standpoint.

EXAMPLE 4

A piece of flooring was fabricated by joining together a decorative veneer board having a width of 300 mm, a length of 900 mm and a thickness of 2.8 mm, a 0.8 mm thick sheet of vinyl chloride containing a lead powder, a veneer board having a thickness of 2.7 mm and a polyethylene foam having a thickness of 5.0 mm.

EXAMPLE 5

A piece of flooring was fabricated by joining together a decorative veneer board having a width of 300 mm, a length of 900 mm and a thickness of 2.8 mm, a 0.8 mm thick sheet of vinyl chloride containing a lead powder, a perforated veneer board having a thickness of 2.7 mm and a hole diameter of 10 mm and a polyethylene foam having a thickness of 5.0 mm.

EXAMPLE 6

A piece of flooring consisting of five units of a top woody board, a sound insulating sheet and an intermediate woody board, and a single piece of buffering material was fabricated by repeating the procedure of EXAMPLE 2 and employing the same boards, sheet and foam as those employed in EXAMPLE 4.

Figure 6:
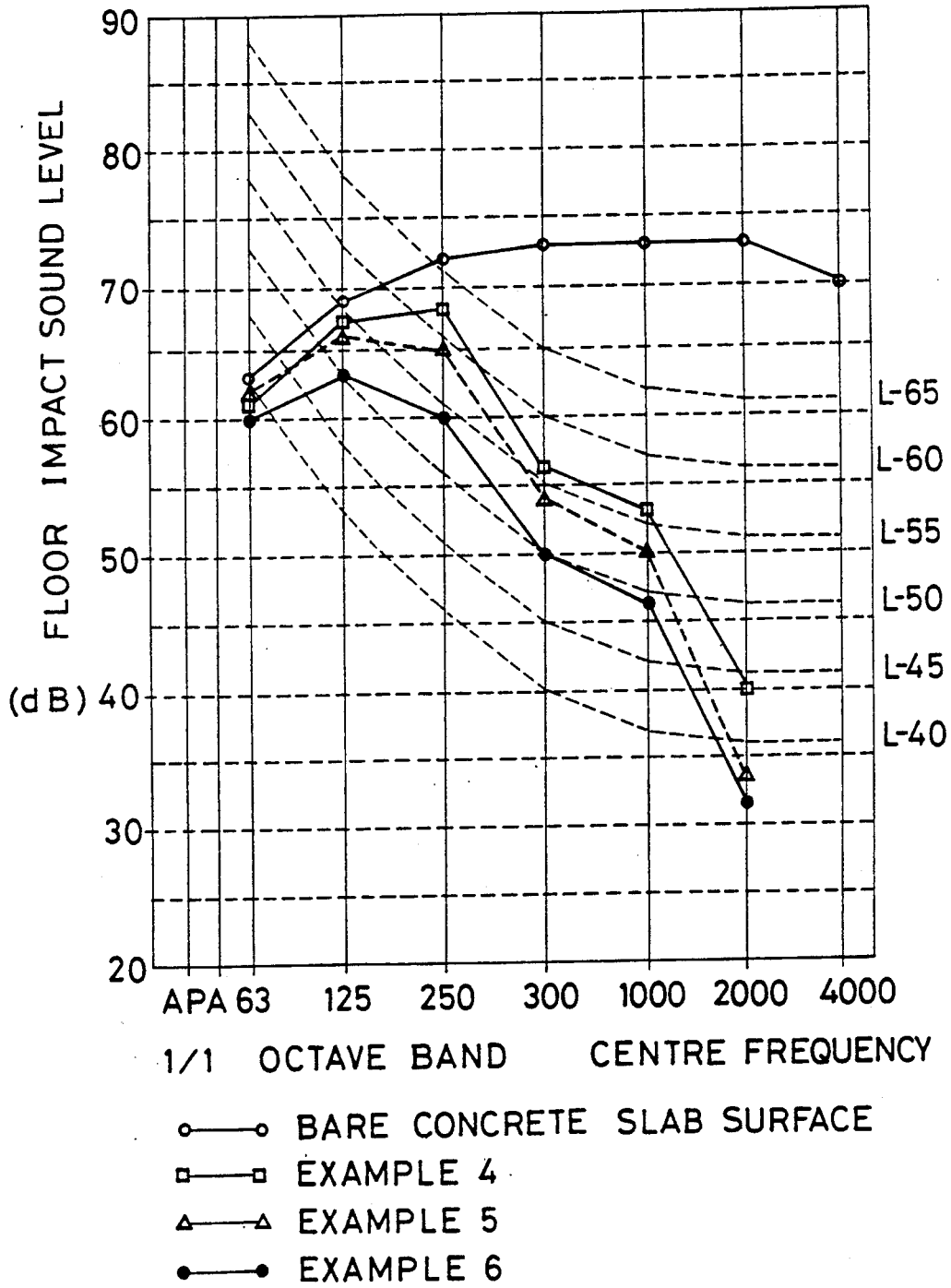
FIG. 6 is a graph similar to FIG. 5, but referring to other of this invention.

Each of the products of EXAMPLES 4 to 6 was tested for its soundproofing property. The results are shown in FIG. 6. As is obvious therefrom, all of the products according to this invention showed excellent soundproofing property, as compared with a bare concrete slab surface.

Although all of the examples have been described as employing a sound insulating sheet, similar results were obtained from the examples in which a vibration damping sheet was used instead of a sound insulating sheet.

EXAMPLE 7

A piece of flooring was fabricated by joining together a veneer board having a thickness of 4 mm, a polyethylene foam containing calcium carbonate and having a thickness of 1.5 mm, a perforated veneer board having a thickness of 2.7 mm and a hole diameter of 10 mm and a rubber foam having a thickness of 5 mm.

EXAMPLE 8

A piece of flooring was fabricated by repeating EXAMPLE 7, except that two perforated veneer boards were employed and put together in such a way that the holes in one of the boards might be located in a staggered relation to those in the other board.

Figure 7:
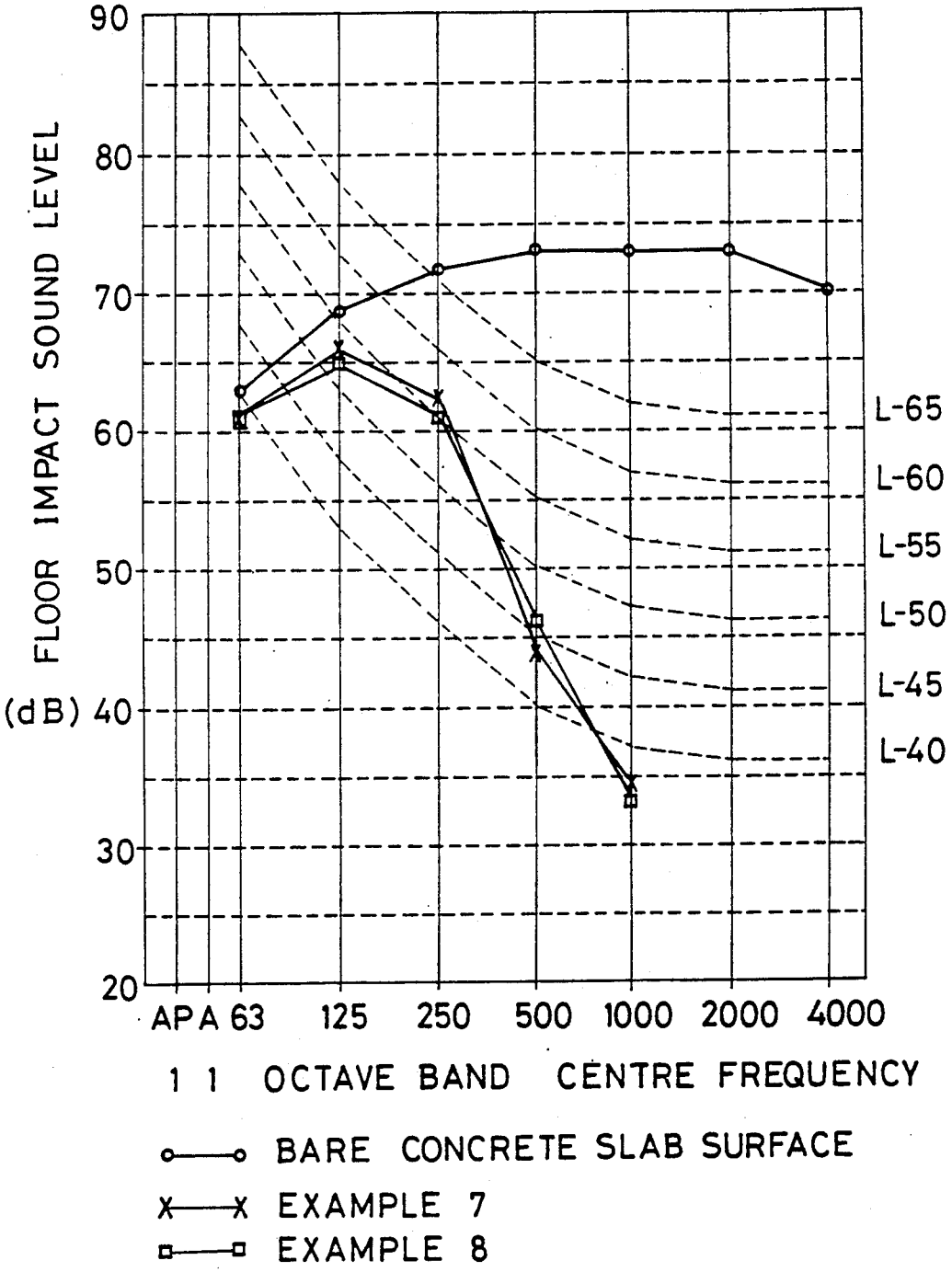
FIG. 7 is a graph similar to FIG. 5, but referring to still other examples.

Each of the products of EXAMPLES 7 and 8 was tested for its soundproofing property. The results are shown in FIG. 7. It is obvious therefrom that the use of a buffering sheet between the woody boards is also effective from a soundproofing standpoint, and that a flooring including two perforated intermediate woody boards has a higher soundproofing property than that of a flooring including only a single perforated board.

EXAMPLE 9

A piece of flooring was fabricated by joining together a decorative veneer board having a width of 300 mm, a length of 900 mm and a thickness of 4.0 mm and covered with a projecting board, a rubber foam having a thickness of 1.5 mm and including a woven fabric glued to its surface facing the decorative veneer board, a perforated veneer board having a thickness of 4.0 mm and a polyolefin foam having a thickness of 7.0 mm. The flooring had a high adhesive strength between the decorative board and the rubber foam and showed excellent soundproofing property.

EXAMPLE 10

A piece of flooring was fabricated by repeating EXAMPLE 9, except that the rubber foam was provided on the opposite side thereof from the oven fabric with a multiplicity of small holes spaced apart from one another by a distance of 1 cm and each having a diameter of 1 mm. The flooring had a high adhesive strength between the two woody boards and the rubber foam and showed excellent soundproofing property.

As is obvious from the foregoing description, the flooring of this invention has excellent soundproofing property. It is also obvious that the woven or unwoven fabric glued to the buffering sheet improves its adherence to the woody board.

What is claimed is:

1. A soundproof woody flooring, comprising:

a plurality of pieces each comprising a top woody board, a sound insulating sheet glued to said board and a perforated woody board glued to said sheet on the opposite side thereof from said top woody board;

said plurality of pieces having generally opposed tongue and groove formations thereon so that each piece of said plurality is engageable with the groove and tongue formations, respectively, on an adjacent piece of said plurality of pieces, each said piece of said plurality of pieces being further formed with a first notched surface below said tongue formation thereon and a second notched surface below said groove formation thereon, the corresponding said first and second notched surfaces of any pair of adjacent pieces forming a groove-like cavity upon engagement of the corresponding tongue and groove formations thereof;

said plurality of pieces being arranged and joined to one another along the longitudinal edges thereof with transverse edges being located in generally staggered relation from each other to the longitudinal direction to avoid alignment of the transverse edges so as to form an assembly of pieces; and a buffering material glued to the whole bottom surface of said plurality of pieces, whereby a single unit of flooring is obtained.

2. A soundproof woody flooring as set forth in claim 11, wherein said woody board comprises a plurality of decorative veneer boards.

3. A soundproof woody flooring as set forth in claim 1 or 2 wherein said perforated woody board comprises two unit perforated woody boards glued to each other, the holes of one of said unit perforated woody board being located in a staggerated relation to those of the other.

4. A soundproof woody flooring as set forth in claim 3, wherein said foam buffering material has a bottom surface provided with a plurality of projections.

5. A soundproof woody flooring as set forth in claim 1, wherein said sound insulating sheet comprises vinyl chloride containing a lead powder.

6. A soundproof woody flooring as set forth in claim 1, wherein said sound insulating sheet comprises a rubber containing an organic powder.

7. A soundproof woody flooring, comprising:

a plurality of pieces each comprising a top woody board, a vibration damping sheet glued to said board and a perforated woody board glued to said sheet on the opposite side thereof from said top woody board;

said pieces being arranged and joined to one another along the longitudinal edges thereof with transverse edges being located in generally staggered relation from each other to the longitudinal direction to avoid alignment of the transverse edges so as to form an assembly of pieces; and a foam buffering material glued to the whole bottom surface of said assembly of pieces, whereby a single unit of flooring is obtained;

wherein said perforated woody board comprises two unit perforated woody boards glued to each other, the holes of one of said unit perforated woody boards being located in a staggerated relation to those of the other.

8. A soundproof woody flooring as set forth in claim 7, wherein said woody board comprises a plurality of decorative veneer boards.

9. A soundproof woody flooring, comprising:

a plurality of pieces each comprising a top woody board, a buffering sheet glued to said board and a perforated woody board glued to said sheet on the opposite side thereof from said top woody board;

said pieces being arranged and joined to one another along the longitudinal edges thereof with transverse edges being located in generally staggered relation from each other to the longitudinal direction to avoid alignment of the transverse edges so as to form an assembly of pieces; and a foam buffering material glued to the whole bottom surface of said assembly of pieces, whereby a single unit of flooring is obtained;

wherein said perforated woody board comprises two unit perforated woody boards glued to each other, the holes of one of said unit perforated woody boards being located in a staggerated relation to those of the other.

10. A soundproof woody flooring as set forth in claim 9, wherein said woody board comprises a plurality of decorative veneer boards.

* * * * *